United States Patent [19]

Dysarz

[11] 4,217,314

[45] Aug. 12, 1980

[54] CARBURETOR AND METHOD OF OPERATION

[75] Inventor: Dennis R. Dysarz, Sterling Heights, Mich.

[73] Assignee: General Motors Corporation, Detroit, Mich.

[21] Appl. No.: 919,257

[22] Filed: Jun. 26, 1978

[51] Int. Cl.[2] ..... F02M 7/24

[52] U.S. Cl. ..... 261/50 R; 123/457; 123/489; 123/437; 137/595; 251/129; 261/69 R; 261/121 B; 261/DIG. 74

[58] Field of Search ..... 261/121 B, DIG. 74, 261/50 R, 69 R; 123/119 EC, 32 EA, 32 EE; 137/595; 251/129

[56] References Cited

U.S. PATENT DOCUMENTS

| | | | |
|---|---|---|---|
| 1,197,571 | 9/1916 | Bessom | 261/121 B |
| 2,220,558 | 11/1940 | Van Dijck et al. | 123/198 |
| 2,355,090 | 8/1944 | Love et al. | 261/DIG. 74 |
| 2,747,561 | 5/1956 | Dietrich | 261/DIG. 74 |
| 2,791,995 | 5/1957 | Dietrich | 261/DIG. 74 |
| 2,831,471 | 4/1958 | Schoonover | 261/DIG. 74 |
| 2,891,577 | 6/1959 | Stewart, Jr. | 137/595 |
| 2,991,799 | 7/1961 | Littlefield | 137/595 |
| 3,059,909 | 10/1962 | Wise | 261/39 B |
| 3,313,532 | 4/1967 | Carlson et al. | 261/121 B |
| 3,371,684 | 3/1968 | Dupont | 137/595 |
| 3,425,672 | 2/1969 | Seigel et al. | 261/121 B |
| 3,454,264 | 7/1969 | Sarto | 261/121 B |
| 3,469,590 | 9/1969 | Barker | 251/129 |
| 3,575,390 | 4/1971 | Bickhaus et al. | 261/121 B |
| 3,633,869 | 1/1972 | Lehmann | 251/129 |
| 3,653,642 | 8/1972 | Lawrence | 261/39 B |
| 3,667,739 | 6/1972 | Menke | 261/1 |
| 3,703,888 | 11/1972 | Eckert et al. | 123/139 AW |
| 3,706,444 | 12/1972 | Masaki et al. | 261/121 B |
| 3,744,346 | 7/1973 | Miner et al. | 261/69 R |
| 3,827,237 | 8/1964 | Linder et al. | 123/32 EH |
| 3,841,283 | 10/1974 | Wood | 261/DIG. 74 |
| 3,852,383 | 12/1974 | Seaman | 261/69 R |
| 3,855,974 | 12/1974 | Mayer | 123/32 EE |
| 3,859,397 | 1/1975 | Tryon | 261/121 B |
| 3,861,366 | 1/1975 | Masaki et al. | 123/32 EA |
| 3,872,188 | 3/1975 | Brown et al. | 261/121 B |
| 3,874,171 | 4/1975 | Schmidt et al. | 123/32 EH |
| 3,906,910 | 9/1975 | Szlaga et al. | 261/121 B |
| 3,921,612 | 11/1975 | Hono | 123/32 EA |
| 3,936,516 | 2/1976 | Nakagawa et al. | 261/121 B |
| 3,939,654 | 2/1976 | Creps | 60/276 |
| 3,942,493 | 3/1976 | Linder et al. | 261/DIG. 74 |
| 3,960,118 | 6/1976 | Konomi et al. | 123/32 EA |
| 3,963,009 | 6/1976 | Mennesson | 123/119 D |
| 3,994,998 | 11/1976 | Mineck | 261/50 A |
| 4,019,474 | 4/1977 | Nishimiya et al. | 123/32 EE |
| 4,023,357 | 5/1977 | Masaki | 123/119 EC |
| 4,027,637 | 6/1977 | Ano | 123/119 EC |
| 4,030,292 | 6/1977 | Masaki et al. | 123/119 EC |
| 4,036,186 | 7/1977 | Hattori et al. | 123/32 EA |
| 4,046,118 | 9/1977 | Aono | 123/119 EC |
| 4,046,165 | 9/1977 | Rose, Sr. et al. | 137/625.6 |
| 4,056,932 | 11/1977 | Nakamura et al. | 60/276 |
| 4,065,920 | 1/1978 | Minami | 123/119 EC |
| 4,132,199 | 1/1979 | Kuroiwa et al. | 123/119 EC |
| 4,136,645 | 1/1979 | Ito et al. | 123/32 EA |

FOREIGN PATENT DOCUMENTS

| | | | |
|---|---|---|---|
| 2715014 | 12/1977 | Fed. Rep. of Germany | 123/119 EC |

OTHER PUBLICATIONS

Society of Automotive Engineers, Paper No. 780,204, 227–278.

Automotive Engineering, Oct. 1977, p. 38.

1976 Oldsmobile Service Chassis Manual, pp. 6M–35 thru 6M–57.

SAE Paper, 770,352, 2–28–77, Gantzert et al.

Carter Carburetor Sketches, TQ and YF/YFA, (no date).

Rochester Products Bulletin 9D–S, "Quadrajet", G. M. Corp., 10–65.

*Primary Examiner*—Tim R. Miles

*Attorney, Agent, or Firm*—C. K. Veenstra

[57] ABSTRACT

During engine operation at low induction passage pressure, a carburetor main metering rod and idle bleed valve are reciprocated between a rich position and a lean position in response to energization of a solenoid according to a pulse width modulated duty cycle, while during operation at high induction passage pressure, the metering rod and bleed valve are moved to the rich position by a piston/spring combination.

9 Claims, 3 Drawing Figures

CARBURETOR AND METHOD OF OPERATION

This invention relates to a carburetor particularly suitable for operation in a closed loop fuel system.

Several carburetors have been proposed for the purpose of creating an air-fuel mixture of substantially constant (usually stoichiometric) air-fuel ratio for an internal combustion engine. In general, it has been contemplated that such a carburetor would be used in a closed loop system having a sensor—such as a sensor that measures the oxygen content of the engine exhaust gases as an indication of the air-fuel ratio of the mixture created by the carburetor—which would initiate a feedback signal causing the carburetor to create a mixture of the desired air-fuel ratio.

One carburetor proposed for that application has metering apparatus which includes a main metering rod and an idle bleed valve driven by a solenoid armature between rich and lean positions according to a pulse width modulated duty cycle. The duty cycle operated solenoid maintains the metering apparatus in the lean position for a selected portion of the duty cycle and in the rich position for the remainder of the duty cycle, and the carburetor thus pulse width modulates the fuel flow and then averages high and low fuel flows to create a mixture of the desired air-fuel ratio.

However, that carburetor does not have the advantage of the more conventional carburetors in which a piston/spring combination automatically moves a main metering rod to a rich position to help create the rich mixture required for maximum power during operation at high induction passage pressures.

This invention provides a carburetor which modulates the fuel flow to create a mixture of the desired air-fuel ratio during operation at low induction passage pressures and which automatically creates a rich mixture during operation at high induction passage pressures. In the preferred embodiments of this carburetor, the metering apparatus is biased toward a rich position by a spring and toward a lean position by a piston responsive to induction passage pressure, and a solenoid energized according to a pulse width modulated duty cycle adds a bias which supplements that of either the spring or the piston. The metering apparatus accordingly reciprocates between the rich and lean positions to pulse width modulate the fuel flow and create a mixture of the desired air-fuel ratio when the induction passage pressure is below a certain level, but the metering apparatus is moved to the rich position to create a rich mixture when the induction passage pressure is above that level.

It will be appreciated that when the metering apparatus of such a carburetor includes a metering rod controlling fuel flow through a metering orifice, the rich position of the metering rod must be accurately located in relation to the metering orifice both to create the desired air-fuel ratio when pulse width modulating the fuel flow and to create the rich mixture when operating with high induction passage pressure. The prior carburetor has a stop, engaged by the metering apparatus in the rich position, which is adjusted to accurately position the metering rod in relation to the metering orifice.

This invention also provides a carburetor in which such a rich stop is formed by an adjustable air bleed body that is engaged by an idle bleed valve as the metering apparatus reaches the rich position. The function of the rich stop thus is combined with that of the air bleed body to provide a simplified carburetor structure.

The details as well as other features and advantages of this invention are set forth in the following description and are shown in the drawings in which.

Figure 1:
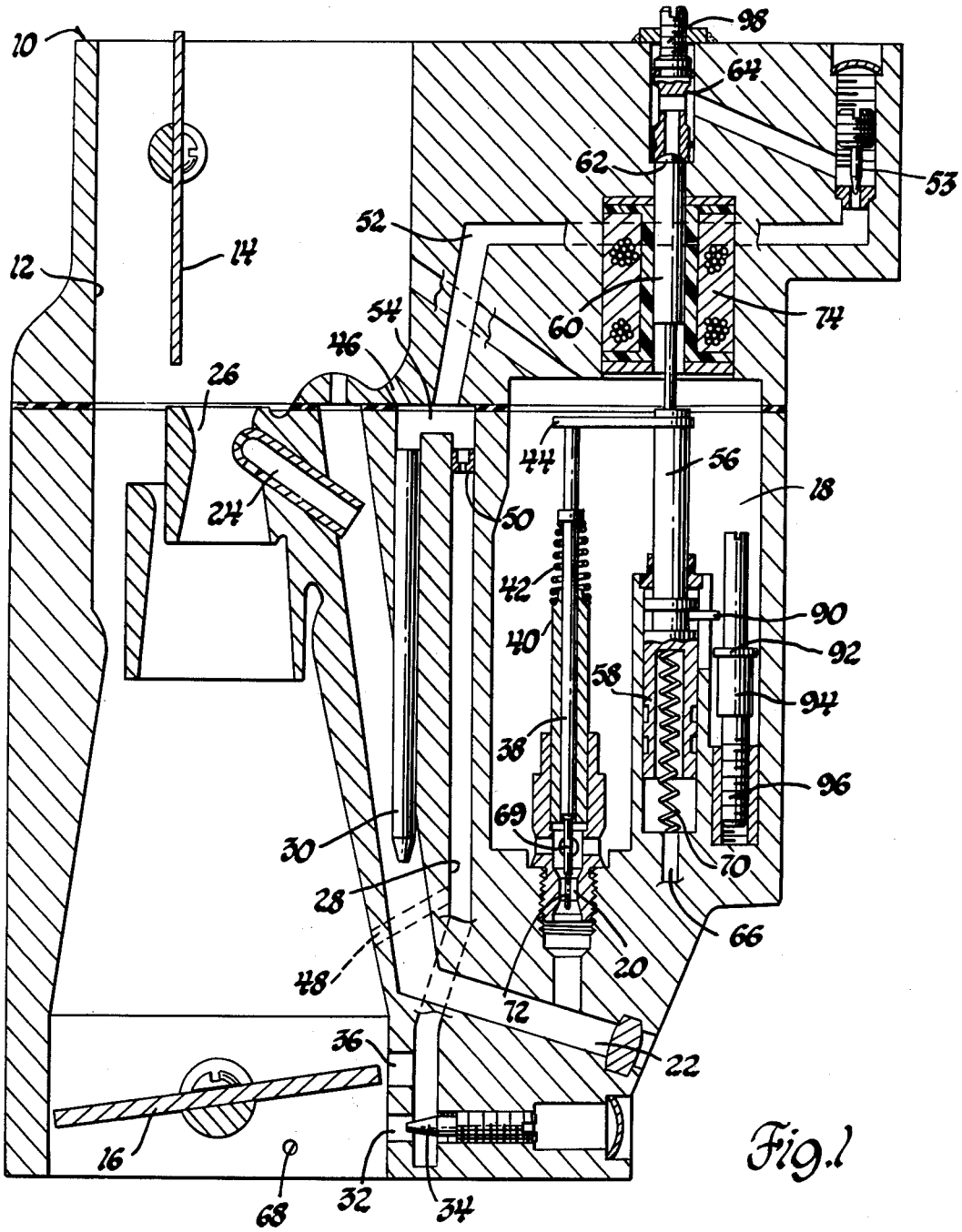
FIG. 1 is a schematic view of the main and idle metering systems of a carburetor employing this invention and in which the solenoid biases the metering apparatus to the lean position.

Referring first to FIG. 1, an internal combustion engine carburetor 10 has an air induction passage 12 controlled by a choke 14 and a throttle 16. A fuel bowl 18 delivers fuel through a metering orifice 20 in a main fuel passage 22 to a nozzle 24 in accordance with the vacuum signal created in a venturi cluster 26 disposed in induction passage 12.

An idle fuel passage 28 has a pick-up tube 30 extending into main fuel passage 22, an idle discharge port 32 opening into induction passage 12 past a mixture adjusting needle 34, and an off-idle port 36 opening into induction passage 12 adjacent throttle 16.

A metering rod 38 (here shown as stepped, but which also may be tapered) is supported in orifice 20 by a guide 40 and is biased upwardly by a spring 42 to engage a bracket 44.

The usual side idle air bleed 46 and lower idle air bleed 48 open into idle fuel passage 28 on opposite sides of an idle channel restriction 50, and an air bleed passage 52 extends past an adjusting needle 53 to the upper portion 54 of idle fuel passage 28.

Bracket 44 is secured to a rod 56 which in turn is secured at its lower end to a vacuum piston 58 and at its upper end to a solenoid armature 60. Armature 60 is grooved or otherwise shaped to permit air flow therepast, and the tip 62 of armature 60 defines an idle bleed valve controlling air flow through an air bleed body 64 to bleed passage 52.

A passage 66 subjects piston 58 to the subatmospheric pressure at a port 68 in induction passage 12 downstream of throttle 16; piston 58 accordingly biases the metering apparatus (piston 58, rod 56 and bracket 44, armature 60, bleed valve 62 and metering rod 38) toward a lean position in which an enlarged step 69 on metering rod 38 restricts fuel flow through orifice 20 and main fuel passage 22 and in which bleed valve 62 is displaced from air bleed body 64 to permit air flow through bleed passage 52 to idle fuel passage 28 and thereby restrict fuel flow through idle fuel passage 28.

A spring 70 biases the metering apparatus toward a rich position in which the reduced tip 72 of metering rod 38 is disposed in orifice 20 to permit increased fuel flow through orifice 20 and main fuel passage 22 and in which bleed valve 62 engages air bleed body 64 to restrict air flow through bleed passage 52 to idle fuel passage 28 and thereby permit increased fuel flow through idle fuel passage 28.

A solenoid coil 74 surrounds armature 60 and, when energized, imparts a force to armature 60 biasing the metering apparatus toward the lean position. Neither solenoid coil 74 nor piston 58 alone can produce sufficient force to overcome the force of springs 70 and 42. However, when the induction passage pressure is below a certain level and solenoid coil 74 is energized, the bias of armature 60 supplements the bias of piston 58 to move the metering apparatus to the lean position. When the induction passage pressure is above that level, or when solenoid coil 74 is not energized, springs 70 and 42 move the metering apparatus to the rich position.

It is contemplated that coil 74 will be energized according to a duty cycle of about 10 Hz having a pulse width determined by a sensor measuring the air-fuel ratio of the mixture created by carburetor 10, such as a sensor measuring the oxygen content of the engine exhaust gases. Accordingly, when the induction passage pressure is below a certain level, the metering apparatus will be moved to the lean position for a selected portion of the duty cycle and to the rich position for the remainder of the duty cycle; carburetor 10 thus will pulse width modulate the fuel flow and then average high and low fuel flows to create a mixture of the desired air-fuel ratio. On the other hand, when the induction passage pressure is above a certain level, the metering apparatus will remain in the rich position both when coil 74 is energized and when coil 74 is not energized to provide a high fuel flow and create a rich mixture.

Figure 2:
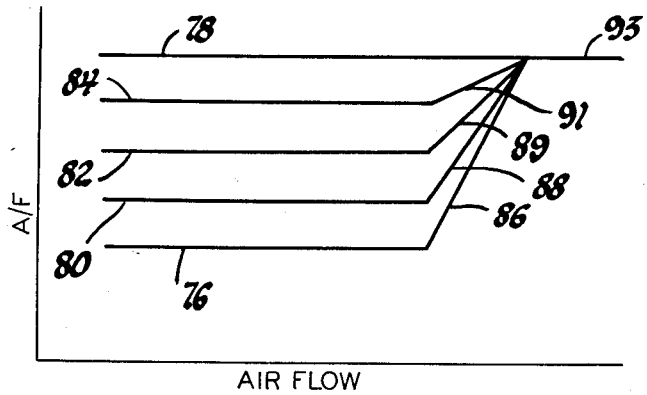
FIG. 2 is a plot illustrating the operation of a carburetor employing this invention.

The operation of carburetor 10 is illustrated in FIG. 2 where air-fuel ratio (A/F) is plotted against induction passage air flow. At low air flows and with the metering apparatus in the lean position (100% duty cycle), the vacuum signal created in venturi cluster 26 will induce fuel flow to create a lean mixture of constant A/F as represented by the lower line 76. At low air flows and with the metering apparatus in the rich position (0% duty cycle), a rich mixture of constant A/F is created as represented by the upper line 78. At low air flows and with coil 74 energized according to a duty cycle between 0% and 100%, the fuel flow is pulse width modulated and then averaged to create a mixture of intermediate A/F as represented by the lines 80, 82 and 84 corresponding to 75%, 50% and 25% duty cycles.

As induction passage air flow increases, the induction passage pressure rises and eventually reaches the level where the bias of piston 58 and armature 60 is insufficient to overcome the bias of springs 70 and 42. During transition through this level, the bias of piston 58 and armature 60 moves the metering apparatus from the rich position to an intermediate position only part way to the lean position, and the A/F created at 100% duty cycle is indicated by the line 86, the shape of which depends on the bias of armature 60, the rate of springs 70 and 42 and the configuration of metering rod 38, particularly in the area between enlarged step 69 and reduced tip 72. Moreover, since during transition through this level the bias of piston 58 and armature 60 moves the metering apparatus only to an intermediate position, the mixtures created at duty cycles between 0% and 100% gradually increase as shown by lines 88, 89 and 91 from an intermediate A/F to the rich A/F.

At higher air flows the mixture has a rich A/F as represented by the extension 93 of line 78, and variations in the duty cycle do not affect the A/F.

Accordingly, it will be appreciated that this carburetor automatically creates a rich mixture when the induction passage pressure is above a certain level and creates a mixture having an air-fuel ratio determined by the duty cycle pulse width at other times.

Piston 58 carries a pin 90 which engages a flange 92 of a stop 94 in the lean position. Stop 94 is threaded at 96 so it may be adjusted to establish the lean position of metering rod 38 relative to metering orifice 20.

As noted above, bleed valve 62 engages air bleed body 64 in the rich position. Air bleed body 64 is threaded at 98 so it may be adjusted to establish the rich position of metering rod 38 relative to metering orifice 20.

Figure 3:
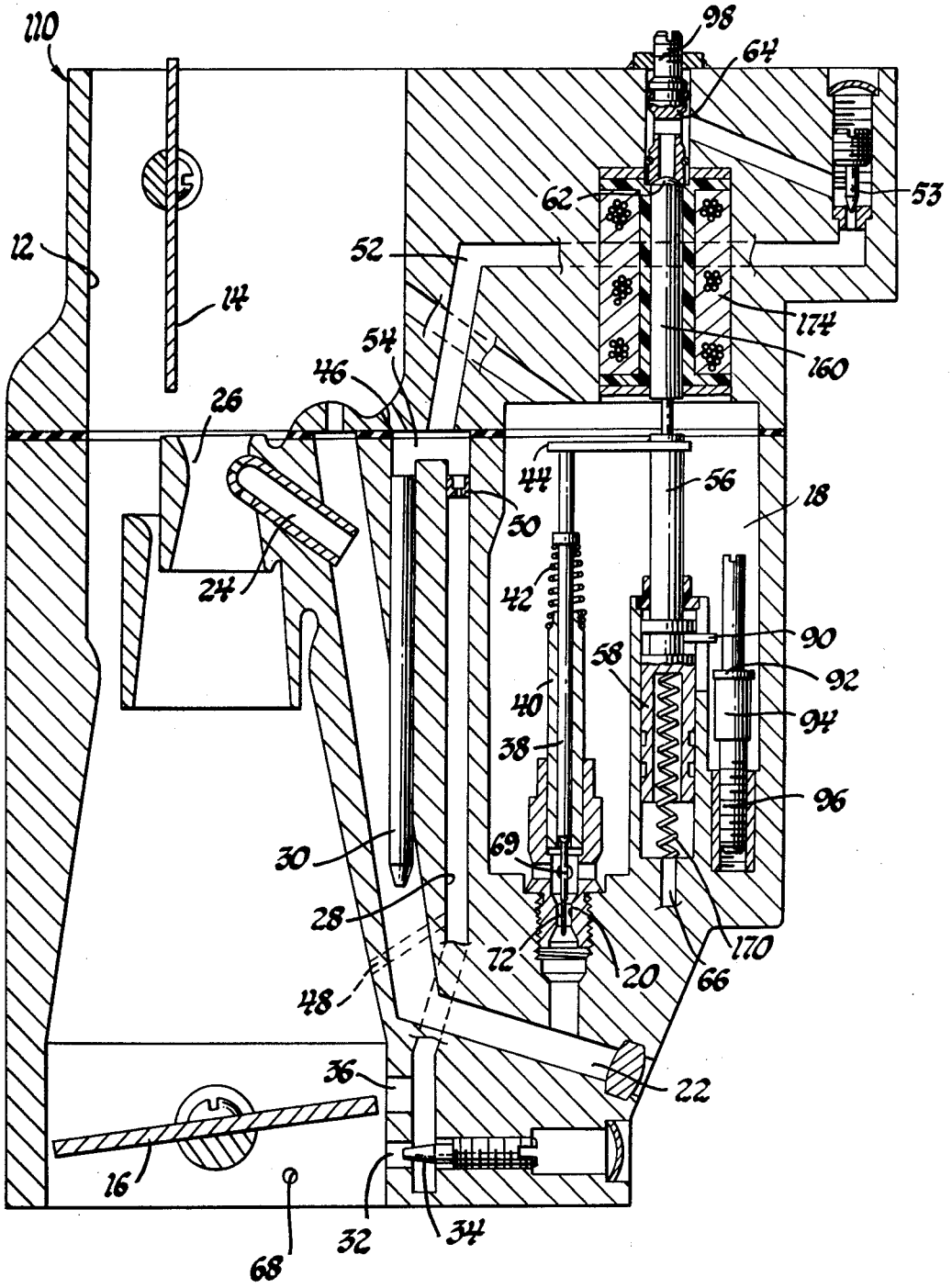
FIG. 3 is a view, similar to FIG. 1, of another carburetor employing this invention and in which the solenoid biases the metering apparatus to the rich position.

FIG. 3 illustrates a carburetor 110 identical in many respects to carburetor 10, and the same reference numerals are used to identify identical parts. In carburetor 110, however, spring 170 is weaker than spring 70 of carburetor 10, and solenoid armature 160 is driven by solenoid coil 174 to bias the metering apparatus toward the rich position.

Thus when the induction passage pressure is below a certain level and solenoid coil 174 is energized, the bias of armature 160 and springs 170 and 42 moves the metering apparatus to the rich position, and when the induction passage pressure is below that level and solenoid coil 174 is not energized, the bias of piston 58 moves the metering apparatus to the lean position. When induction passage pressure is above that level, springs 170 and 42 move the metering apparatus to the rich position both when coil 174 is energized and when coil 174 is not energized.

The embodiments of the invention in which an exclusive property or privilege is claimed are defined as follows:

1. A carburetor comprising an induction passage, a throttle in said induction passage, a fuel passage, a metering apparatus reciprocable between a lean position and a rich position and including a metering element effective to restrict fuel flow through said fuel passage in said lean position and to permit increased fuel flow through said fuel passage in said rich position, said metering apparatus further including a force producing piston member responsive to the pressure in said induction passage downstream of said throttle for biasing said metering apparatus toward said lean position, and a force producing spring member having a bias opposing the bias of said piston member and effective to move said metering apparatus to said rich position when said pressure is above a predetermined level, and wherein said carburetor also comprises a solenoid coil and said metering apparatus also includes a solenoid armature which upon energization of said coil has a bias supplementing the bias of one of said force producing members and opposing the bias of the other force producing member, whereby said metering apparatus is disposed in a position determined by energization of said solenoid coil when said pressure is below a certain level and in said rich position when said pressure is above said certain level.

2. A carburetor comprising an induction passage, a throttle in said induction passage, a fuel passage, a metering apparatus reciprocable between a lean position and a rich position and including a metering element effective to restrict fuel flow through said fuel passage in said lean position and to permit increased fuel flow through said fuel passage in said rich position, said metering apparatus further including a force producing piston member responsive to the pressure in said induction passage downstream of said throttle for biasing said metering apparatus toward said lean position, and a force producing spring member having a bias opposing the bias of said piston member and effective to move said metering apparatus to said rich position when said pressure is above a predetermined level, and wherein said carburetor also comprises a solenoid coil energized according to a duty cycle and said metering apparatus also includes a solenoid armature which upon energization of said coil has a bias supplementing the bias of one of said force producing members and opposing the bias of the other force producing member, whereby when said pressure is below a certain level said metering apparatus is disposed in said lean position during a portion of the duty cycle and in said rich position during the remainder of the duty cycle, and whereby when said pressure is above said certain level said metering apparatus is continuously disposed in said rich position.

3. A carburetor comprising an induction passage, a throttle in said induction passage, a fuel passage, a metering apparatus reciprocable between a lean position and a rich position and including a metering element effective to restrict fuel flow through said fuel passage in said lean position and to permit increased fuel flow through said fuel passage in said rich position, said metering apparatus further including a piston responsive to the pressure in said induction passage downstream of said throttle for biasing said metering apparatus toward said lean position, and a spring having a bias opposing the bias of said piston and effective to move said metering apparatus to said rich position when said pressure is above a predetermined level, and wherein said carburetor also comprises a solenoid coil energized according to a duty cycle and said metering apparatus also includes a solenoid armature which during energization of said coil has a bias supplementing the bias of said spring and opposing the bias of said piston, whereby when said pressure is below a certain level said metering apparatus is disposed in said rich position when said coil is energized and in said lean position when said coil is not energized, and whereby when said pressure is above said certain level said metering apparatus is disposed in said rich position both when said coil is energized and when said coil is not energized.

4. A carburetor comprising an induction passage, a throttle in said induction passage, a fuel passage, a metering apparatus reciprocable between a lean position and a rich position and including a metering element effective to restrict fuel flow through said fuel passage in said lean position and to permit increased fuel flow through said fuel passage in said rich position, said metering apparatus further including a piston responsive to the pressure in said induction passage downstream of said throttle for biasing said metering apparatus toward said lean position, and a spring having a bias opposing the bias of said piston and effective to move said metering apparatus to said rich position when said pressure is above a predetermined level, and wherein said carburetor also comprises a solenoid coil energized according to a duty cycle and said metering apparatus also includes a solenoid armature which upon energization of said coil has a bias supplementing the bias of said piston and opposing the bias of said spring, whereby when said pressure is below a certain level said metering apparatus is disposed in said lean position when said coil is energized and in said rich position when said coil is not energized, and whereby when said pressure is above said certain level said metering apparatus is disposed in said rich position both when said coil is not energized and when said coil is energized.

5. A carburetor comprising an induction passage, a throttle in said induction passage, main and idle fuel passages opening into said induction passage, a metering orifice in said main fuel passage, a metering apparatus reciprocable between a lean position and a rich position and including a metering rod restricting fuel flow through said metering orifice in said lean position and permitting increased fuel flow through said metering orifice in said rich position, an air bleed body defining a portion of an air bleed opening into said idle fuel passage, said metering apparatus additionally including a bleed valve restricting air flow through said air bleed to permit increased fuel flow through said idle fuel passage in said rich position and permitting increased air flow through said air bleed to restrict fuel flow through said idle fuel passage in said lean position, said metering apparatus further including a piston responsive to the pressure in said induction passage downstream of said throttle for biasing said metering apparatus toward said lean position, a spring having a bias opposing the bias of said piston and effective to move said metering apparatus to said rich position when said pressure is above a predetermined level, and a solenoid coil energized according to a duty cycle, said metering apparatus also including a solenoid armature which upon energization of said coil has a bias supplementing the bias of said piston and opposing the bias of said spring, whereby when said pressure is below a certain level said metering apparatus is disposed in said lean position when said coil is energized and in said rich position when said coil is not energized, and whereby when said pressure is above said certain level said metering apparatus is disposed in said rich position both when said coil is not energized and when said coil is energized, wherein said carburetor further comprises a lean stop engaged by said metering apparatus in said lean position, said lean stop including means for adjusting its position to establish said lean position, and wherein said air bleed body defines a rich stop engaged by said bleed valve in said rich position, said rich stop including means for adjusting its position to establish said rich position.

6. A carburetor comprising main and idle fuel passages, a metering orifice in said main fuel passage, a metering apparatus reciprocable between a lean position and a rich position, said metering apparatus including a metering rod which restricts fuel flow through said metering orifice in said lean position and permits increased fuel flow through said metering orifice in said rich position, and an air bleed body defining a portion of an air bleed opening into said idle fuel passage, said metering apparatus also including a bleed valve operatively connected with said metering rod which permits air flow through said bleed to restrict fuel flow through said idle fuel passage in said lean position and engages said body to restrict air flow through said air bleed and permit increased fuel flow through said idle fuel passage in said rich position, and wherein said air bleed body includes means for adjusting its position relative to said metering orifice to establish said rich position.

7. A carburetor comprising main and idle fuel passages, a metering orifice in said main fuel passage, a metering apparatus reciprocable between a lean position and a rich position and including a metering rod restricting fuel flow through said metering orifice in said lean position and permitting increased fuel flow through said metering orifice in said rich position, an air bleed body defining a portion of an air bleed opening into said idle fuel passage, said metering apparatus additionally including a bleed valve restricting air flow through said air bleed to permit increased fuel flow through said idle fuel passage in said rich position and permitting increased air flow through said air bleed to restrict fuel flow through said idle fuel passage in said lean position, a spring biasing said metering apparatus to one of said positions, and a solenoid coil energized according to a duty cycle, said metering apparatus also including a solenoid armature which upon energization of said coil produces a bias overcoming the bias of said spring, whereby said metering apparatus is disposed in the other of said positions when said coil is energized and in said one position when said coil is not energized, wherein said carburetor further comprises a lean stop engaged by said metering apparatus in said lean position, said lean stop including means for adjusting its position to establish said lean position, and wherein said air bleed body defines a rich stop engaged by said bleed valve in said rich position, said rich stop including means for adjusting its position to establish said rich position.

8. The method of operating a carburetor having an induction passage controlled by a throttle and having a fuel passage with a metering orifice controlled by a metering rod, said method comprising the steps of energizing a solenoid according to a duty cycle for reciprocating said metering rod between one position restricting fuel flow through said metering orifice and a second position permitting increased fuel flow through said metering orifice to thereby duty cycle modulate fuel flow through said metering orifice, and varying said one position according to the pressure in said induction passage downstream of said throttle for decreasingly restricting fuel flow through said metering orifice as said induction passage pressure increases.

9. A carburetor comprising an induction passage, a throttle in said induction passage, a fuel passage, a metering apparatus reciprocable between a lean position and a rich position and including a metering element effective to restrict fuel flow through said fuel passage in said lean position and to permit increased fuel flow through said fuel passage in said rich position, said metering apparatus further including a force producing spring member for biasing said metering apparatus toward said rich position, and a force producing piston member responsive to the pressure in said induction passage downstream of said throttle and having a bias effective to overcome the bias of said spring member when said pressure is below a predetermined level, and wherein said carburetor also comprises a solenoid coil and said metering apparatus also includes a solenoid armature which upon energization of said coil has a bias supplementing the bias of one of said force producing members and opposing the bias of the other force producing member, whereby said metering apparatus is disposed in a position determined by energization of said solenoid coil when said pressure is below a certain level and in said rich position when said pressure is above said certain level.

* * * * *